United States Patent [19]

Smrt

[11] 4,093,068

[45] June 6, 1978

[54] PACKING SHEET AND PACKAGES FORMED THEREBY

[75] Inventor: Thomas J. Smrt, Bartlett, Ill.

[73] Assignee: Fox Valley Marking Systems, Inc., Cary, Ill.

[21] Appl. No.: 722,703

[22] Filed: Sep. 13, 1976

[51] Int. Cl.[2] ..... B65D 81/02

[52] U.S. Cl. ..... 206/443; 206/433; 206/522; 206/592; 206/593

[58] Field of Search ..... 206/443, 522, 533, 524, 206/433, 583, 585, 586, 587, 588, 589, 590, 591, 592, 593, 594

[56] References Cited

U.S. PATENT DOCUMENTS

| | | | |
|---|---|---|---|
| D.160,738 | 10/1950 | Randall | 206/589 |
| 2,314,198 | 3/1943 | Reamer | 206/433 |
| 2,808,189 | 10/1957 | Williams | 206/593 |
| 3,098,563 | 7/1963 | Skees | 206/522 |
| 3,142,599 | 7/1964 | Chavannes | 206/522 |
| 3,195,686 | 7/1965 | Johnson | 206/585 |
| 3,366,231 | 1/1968 | Trakas | 206/585 |
| 3,575,781 | 4/1971 | Pezely | 206/591 |

FOREIGN PATENT DOCUMENTS

| | | | |
|---|---|---|---|
| 1,264,538 | 5/1961 | France | 206/433 |
| 1,585,083 | 2/1968 | France | 206/522 |
| 2,435,672 | 7/1974 | Germany | 206/523 |

*Primary Examiner*—Stephen P. Garbe
*Assistant Examiner*—Joseph M. Moy

[57] ABSTRACT

Packing sheet for packaging aerosol cans and the like is formed from two sheets for films of plastic. One of the sheets is vacuum formed to provide a plurality of blisters or bubbles, and the sheets are sealed together to seal air inside the bubbles. The distance between adjacent bubbles is less than the distance between the articles which are to be packed, and the articles are supported by a cushion of air within the bubbles.

3 Claims, 7 Drawing Figures

PACKING SHEET AND PACKAGES FORMED THEREBY

BACKGROUND AND SUMMARY

This invention relates to a packing sheet and a package formed thereby.

It is often desirable to package articles for shipping in a manner that will protect the articles from shocks during transportation. However, packing material which is used to cushion the articles is often bulky, and the bulk of the packing material not only increases the size and/or weight of the package, but may cause problems in shipping the packaging material to the users.

Packaging material formed in accordance with the invention is lightweight, provides shock-absorbing air cushion for articles which are to be packed, and is relatively compact both within a package and during shipment. The packing material is a sheet which is formed from two layers or sheets of plastic which are heat-sealed together. One of the sheets is vacuum formed to provide a plurality of bubbles therein, and air is sealed within the bubbles by the second sheet. The height of the bubbles is relatively low to reduce the bulk of the bubbles, and the distance between adjacent bubbles is less than the width of the articles which are to be packed. The articles are packaged between upper and lower packing sheets, and the articles are supported and cushioned by the air-filled bubbles. The weight of the articles on the bottom packing sheet, and the closing of the carton over the packing sheet, causes edges of the bubbles to be compressed, and the bubbles are forced into the space between adjacent articles.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
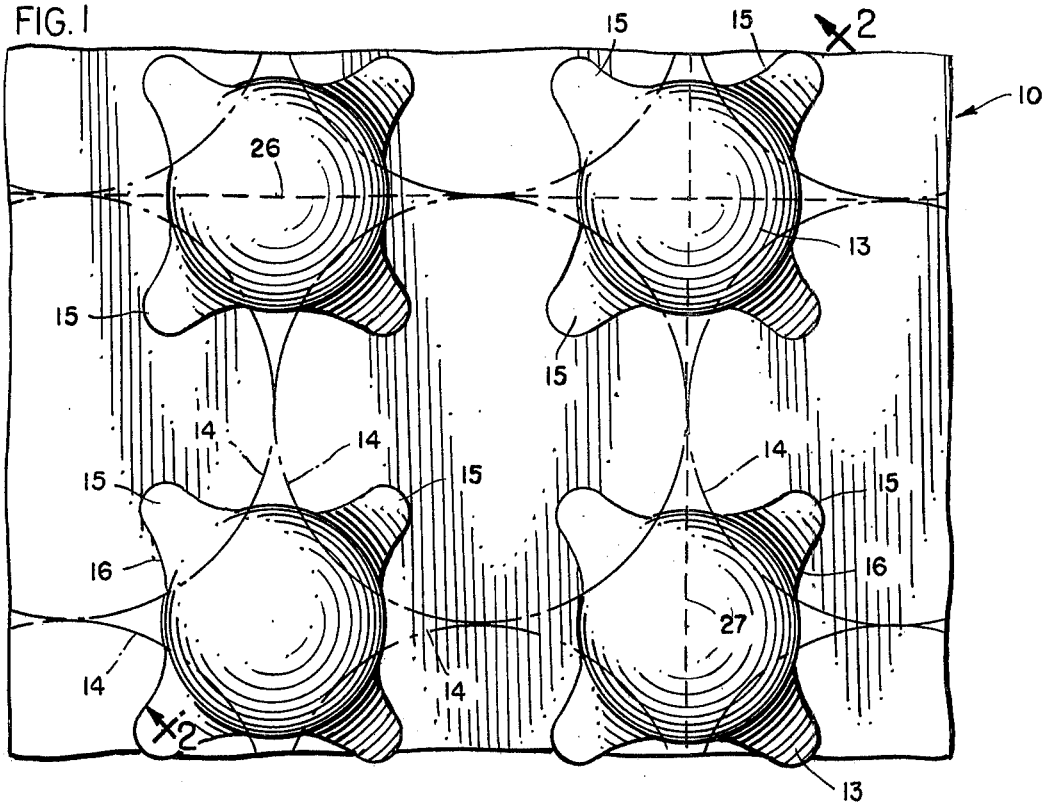
FIG. 1 is a fragmentary top plan view of a packing sheet formed in accordance with the invention.
Figure 2:
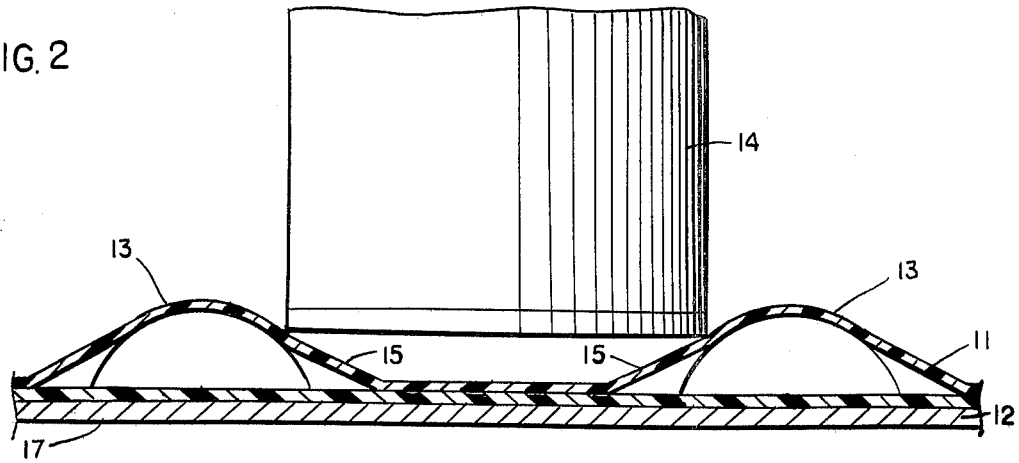
FIG. 2 is an enlarged fragmentary sectional view taken along the line 2—2 of FIG. 1 showing an aerosol can being lowered into place between four adjacent bubbles.

Referring first fo FIGS. 1 and 2, the numeral 10 designates generally a packing sheet which is formed from an upper sheet or film 11 and a lower sheet or film 12 which is secured to the upper sheet as by heat-sealing. The upper sheet is vacuum formed to provide a plurality of bubbles or blisters 13, and the seal between the upper and lower sheets seals air inside each bubble. If desired, some fluid other than air could also be used.

The packing sheet illustrated is intended for use in packaging cylindrical aerosol cans, indicated in phantom in FIG. 1 by the numeral 14, and the bubbles are sized and spaced so that the center of each bubble is positioned in the center of a space between four adjacent cans. The bubbles are slightly larger than the spaces between adjacent cans, and an aerosol can will contact a portion of each of four bubbles when it is supported by the lower packing sheet. In the embodiment illustrated, the portions of a bubble which will be contacted by the aerosol cans project radially inwardly at 15 toward the centers of the cans. Each bubble is therefore provided with two pairs of projections 15 which extend along perpendicularly related diagonal lines within the package, the diagonal lines being aligned with the diameters of the cans. The peripheral portions of the bubbles between the projections extend arcuately as at 16.

Figure 3:
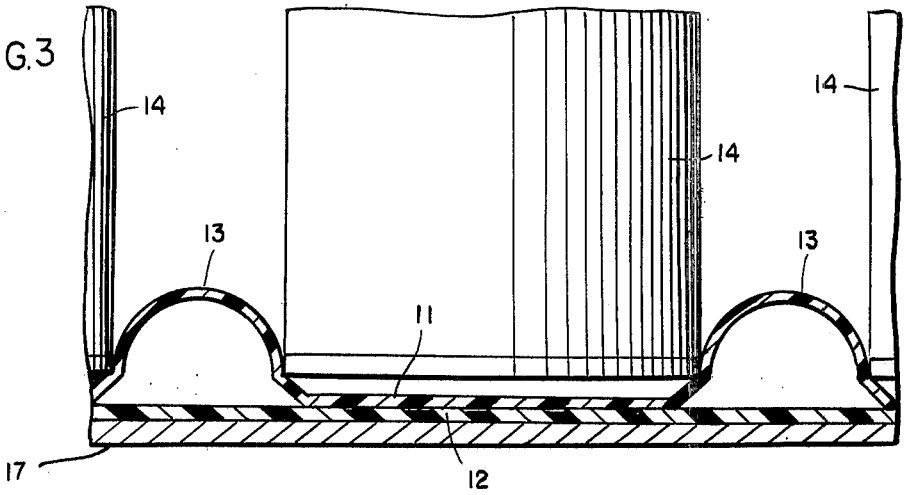
FIG. 3 is an enlarged fragmentary sectional view taken along the line 2—2 showing three aerosol cans being supported by the packing sheet.

FIG. 2 shows the packing sheet supported by the bottom 17 of a container, such as a fiberboard carton, and a can 14 being lowered into position on the packing sheet. The height of the bubbles 13 before the can contacts the projections 15 is three or four times the thickness of the films 11 and 12. As the can is lowered onto the packing sheet, it engages projections 15 of four bubbles, and air is forced out of each bubble into the domed central portion of the bubble. Each bubble is therefore forced upwardly within the space between adjacent cans by increased air pressure within the bubble, as shown in FIG. 3, and the bubble is rigidified by the increased air pressure. Some air remains within the projections below the cans to provide an air cushion support for the cans and the upwardly extending bubbles between the cans provide cushion against laterally directed shocks.

Figure 4:
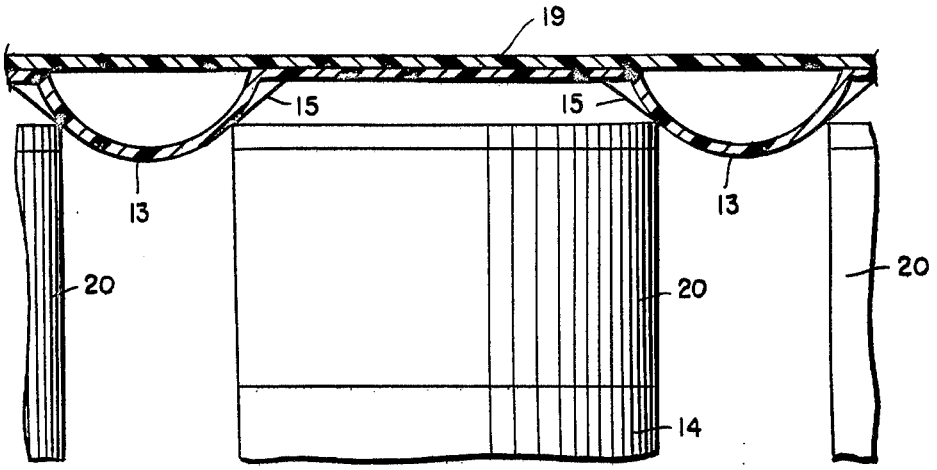
FIG. 4 is a fragmentary sectional view showing a top packing sheet being positioned over the tops of the aerosol cans.

A top packing sheet 19 is illustrated in FIG. 4. The top packing sheet is identical to the bottom packing sheet, and the projections 15 of the bubbles of the top packing sheet engage the cylindrical caps or covers 20 of the aerosol cans which fit over the conventional domed tops of the cans to protect the spray nozzles. The top packing sheet is pressed against the caps by the top 21 of the carton when the carton is closed, as shown in FIG. 5, and this downward pressure causes air to be forced out of the projections of the bubbles and into the central portions of the bubbles, thereby forcing the central portion of the bubbles downwardly in the spaces between the caps of adjacent cans.

Figure 5:
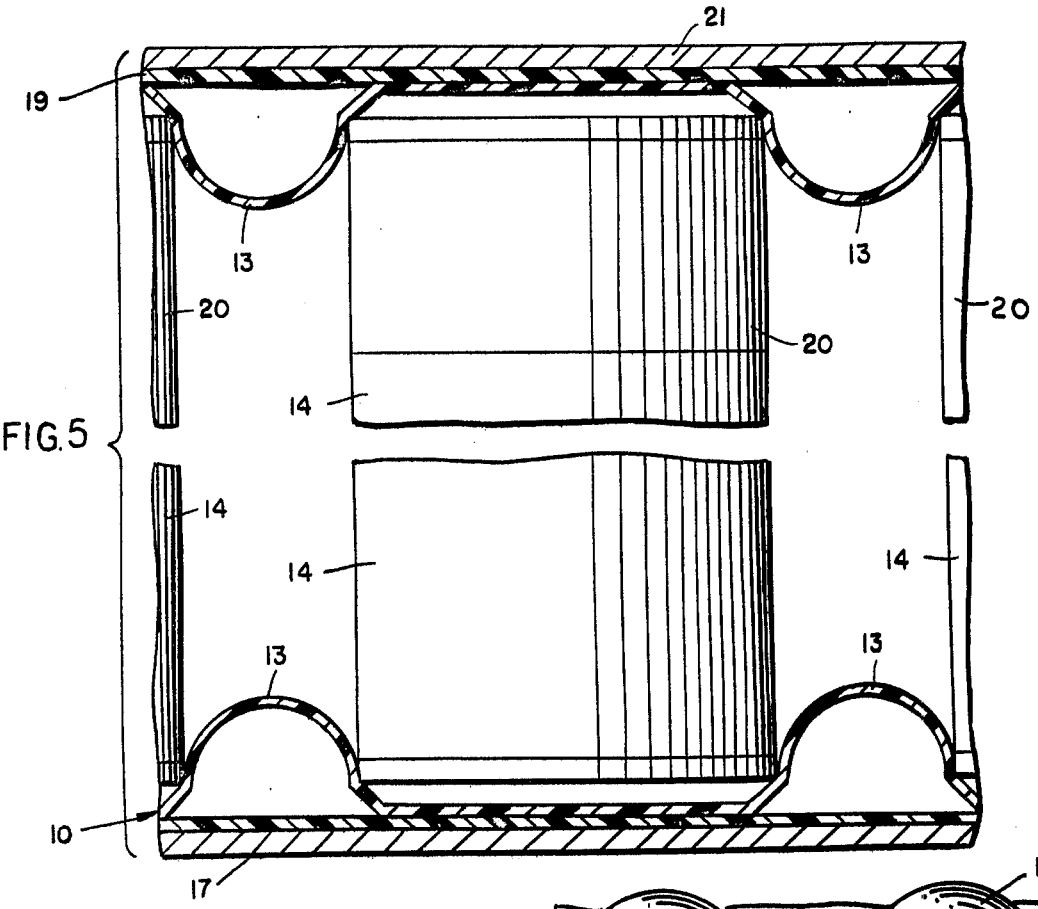
FIG. 5 is a fragmentary sectional view of package showing the top packing sheet being pressed against the tops of the aerosol cans by the top of the package.

FIG. 5 illustrates both the bottom and the top packing sheet and shows how each of the cans is protected by an air cushion above the can, below the can, and at four positions around the top and bottom of the can.

Figure 6:
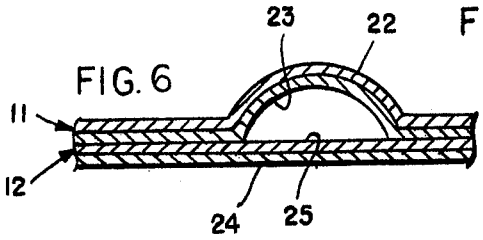
FIG. 6 is a fragmentary sectional view through one of the bubbles showing the air-impervious films.
Figure 7:
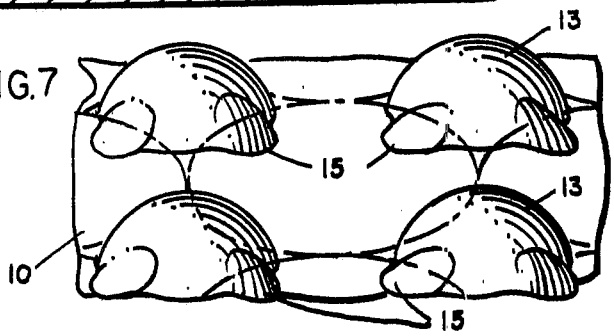
FIG. 7 is a perspective view of the bottom packing sheet.

In one specific embodiment of the packing sheet, I have used polyethylene for the films 11 and 12. While polyethylene provides a strong packing sheet, I have found it desirable to laminate a film of air-impervious material to each of the polyethylene films to ensure against escape of air from the bubbles. This is illustrated in FIG. 6 in which the film 11 is comprised of a polyethylene film 22 and an air-impervious plastic film 23 bonded thereto, and the bottom film 12 is comprised of a polyethylene film 24 and an air-impervious plastic film 25 bonded thereto.

The packing sheet can be packaged and shipped in roll form to the user, i.e., the person who will use the packing material to package articles. Since the height of the bubbles when the packing sheet is not being used to package articles is substantially less than the height when the articles engage and compress the projections 15, the packing sheet can be rolled and shipped in a compact configuration.

The packing sheet can be provided with tear lines or lines of weakness 26 and 27 (FIG. 1) which extend generally perpendicularly to each other and generally parallel to one of the sides of the container. The lines of weakness can be spaced apart at periodic intervals along the length and width of the packing sheet, and the size of the packing sheet can thereby be readily adjusted to fit the size of a particular carton. Each of the tear lines of the packing sheet illustrated in FIG. 1 is aligned with a centerline passing through the centers of one of the rows of bubbles. The edge of the packing sheet formed by tearing along the line of weakness would abut the edge of a carton, and the periphery of a can would also abut the edge of the carton between two blisters. The blisters which are along the lines of weakness would be deflated when the packing sheet was torn, but the cans would be retained against lateral shifting by the side of the carton.

The packing sheet formed in accordance with the invention is extremely light in weight, and, in contrast to some other packing materials, the cost per article of the packing material decreases as the number of articles within a carton increases. For example, a carton which is 1 foot square will require 1 square foot of blister packing material for both the top and the bottom, or a total of 2 sq. ft. The same area of blister packing material will be required whether the size of the cans is such that nine cans can be packaged in the carton, 16 cans, 25 cans, or even 100 cans. All that is required is a difference in the size and spacing of the blisters. However, if vertically extending criss-crossing or intersecting cardboard dividers are used to position and protect the cans, the square feet of divider material increases drastically as the number of cans within the carton increases.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A package comprising a plurality of elongated articles, each article having a top and a bottom, a bottom cushioning sheet supporting the bottoms of the articles, a top cushioning sheet positioned over the tops of the articles, and a carton enclosing the cushioning sheets and the articles, each of the top and bottom cushioning sheets including a plastic sheet having air-tight air-filled compressible bubbles formed therein contacting the articles, each bubble comprising radially outwardly extending projections and being generally positioned in a space between adjacent articles, the spacing between adjacent bubbles of a sheet being less than the width of the articles so that the top and bottom of each article contacts and partially compresses a projection of at least two bubbles whereby the top and bottom of each article is protected within the carton by a cushion of air within the bubbles, the compressing of said projections by the articles causing the height of the bubbles between adjacent articles to be greater than the height of the bubbles before the articles contact the bubbles and the pressure of the air within the bubbles to be greater than the pressure of the air within the bubbles before the articles contact the bubbles.

2. The package of claim 1 in which each of the articles is a generally cylindrical can having a generally circular bottom and a generally circular top each of the bubbles having four radially outwardly extending projections, each projection extending generally along the radius of one of the cans and being engaged and compressed by the periphery of the can.

3. The package of claim 1 in which each of the top and bottom packing sheets includes a second plastic sheet secured to the first plastic sheet to seal the fluid within each of the bubbles.

* * * * *